United States Patent [19]

Takahashi

[11] 4,190,943

[45] Mar. 4, 1980

[54] GASKET INSTALLING DEVICE

[75] Inventor: Kihei Takahashi, Uozu, Japan

[73] Assignee: Yoshida Kogyo K.K., Tokyo, Japan

[21] Appl. No.: 899,868

[22] Filed: Apr. 25, 1978

[30] Foreign Application Priority Data

May 4, 1977 [JP] Japan ..... 52/56890[U]

[51] Int. Cl.[2] ..... B23P 19/02

[52] U.S. Cl. ..... 29/235

[58] Field of Search ..... 29/235, 270; 114/224; 192/45

[56] References Cited

U.S. PATENT DOCUMENTS

| | | | |
|---|---|---|---|
| 1,326,660 | 12/1919 | Hainer | 114/224 |
| 1,875,728 | 9/1932 | Henry | 29/270 |
| 2,761,199 | 9/1956 | Allen | 29/270 |
| 3,007,240 | 11/1961 | Heinrich | 29/235 |
| 3,483,632 | 12/1969 | Triblett | 192/45 |
| 3,847,039 | 11/1974 | Azuma | 81/57.13 |

*Primary Examiner*—James L. Jones, Jr.

*Attorney, Agent, or Firm*—Hill, Van Santen, Steadman, Chiara & Simpson

[57] ABSTRACT

A gasket installing device comprises a hollow frame in which there is rotatably disposed a presser wheel having means on its circumference for engaging and pressing the gasket discharged from a guide passage against the panel edge at a position adjacent to an open side of the hollow frame. The presser wheel is driven by an electric motor through an overrunning clutch mechanism contained in the presser wheel. The clutch mechanism allows the presser wheel to be rotated by the motor only in one direction and also allows the wheel to rotate freely in the same direction when the motor is de-energized.

6 Claims, 6 Drawing Figures

GASKET INSTALLING DEVICE

BACKGROUND OF THE INVENTION

1. Field of the Invention

The present invention relates to a device for installing an elongate gasket continuously along an edge of a panel such as a pane of glass.

2. Prior Art

It has been customary to mount an elongate gasket along an edge of a panel solely by hand. Such gasket is made of a flexible and elastic material such as rubber or synthetic resin, which requires much skill on the part of the installer to prevent the installed gasket's becoming excessively loose or stretched due to changes in ambient temperature and stresses exerted during attachment.

To enable unskilled workers to install the gaskets properly, the applicant has devised a manually operated gasket installing device disclosed and claimed in U.S. patent application Ser. No. 879,714, filed Feb. 21, 1978 which application is incorporated herein by reference.

SUMMARY OF THE INVENTION

A device for installing an elongate gasket continuously along an edge of a panel comprises a presser wheel rotatably disposed in a frame for engaging and pressing the gasket against the panel edge at a position adjacent to an open side of the frame. The presser wheel is driven by an electric motor through an overrunning clutch mechanism contained in the presser wheel, the clutch mechanism allowing the presser wheel to be rotated by the motor only in one direction and to rotate freely of its own accord in said one direction during de-energization of the motor.

An object of the present invention is to provide a gasket installing device having means for automatically feeding a gasket onto the panel edge.

Another object of the present invention is to provide a gasket installing device which enables an unskilled worker to install a gasket reliably and speedily.

Still another object of the present invention is to provide a gasket installing device which can minimize the tension that an elongated gasket will undergo while being mounted continuously on the panel edge.

Yet another object of the present invention is to provide a power-driven gasket installing device which also can be manually operated at will.

Many other advantages features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
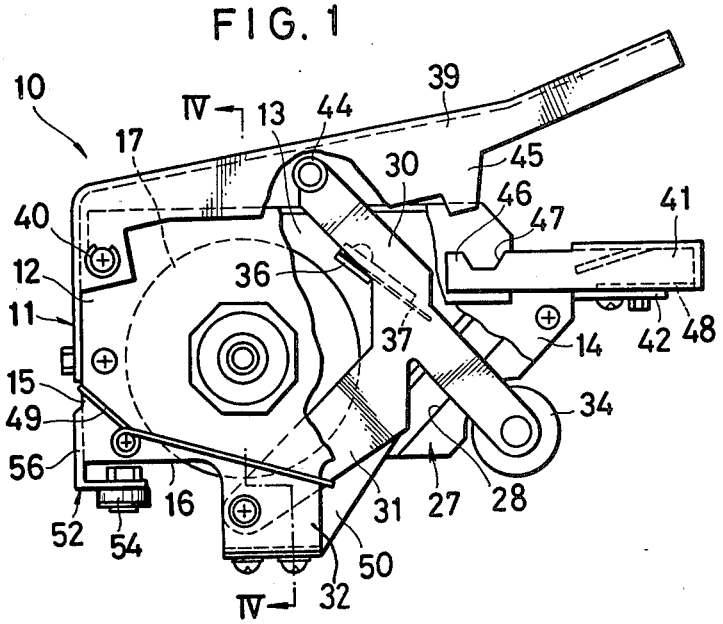
FIG. 1 is a side elevational view with parts cut away of a gasket installing device constructed in accordance with the present invention.
Figure 2:
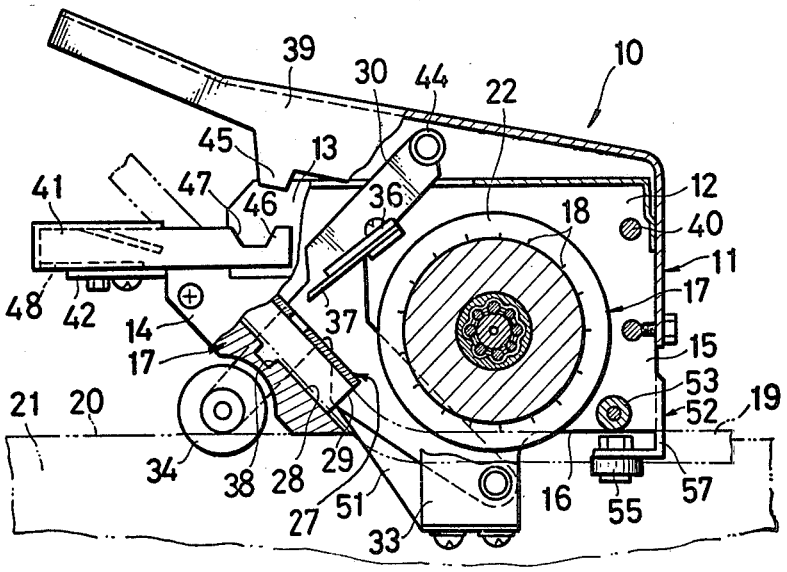
FIG. 2 is a vertical cross-sectional view of the device shown in FIG. 1, the device being reversed.

The principles of the present invention are particularly useful when embodied in a gasket installing device such as shown in FIGS. 1 and 2, generally indicated by the numeral 10.

The gasket installing device 10 comprises a hollow frame 11 including a pair of spaced sidewalls 12, 13 connected together at their upper edges, the frame 11 having a leading end 14, a trailing end 15, and an open lower side 16.

Figure 3:
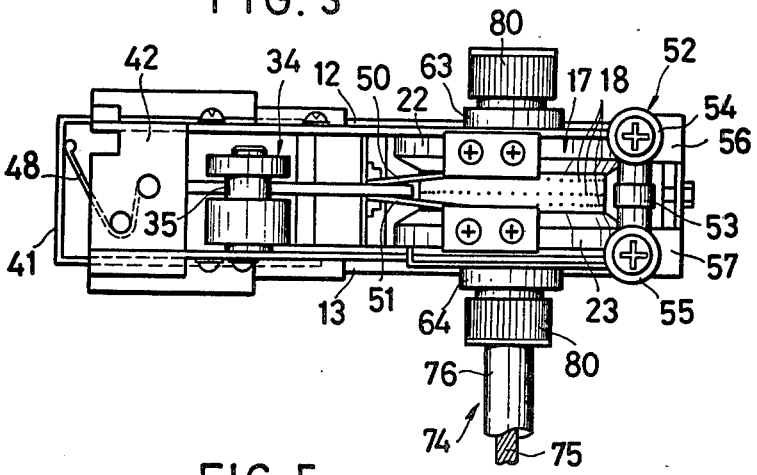
FIG. 3 is a bottom view of the device of FIG. 2.

A presser wheel 17 is rotatably disposed in the hollow frame 11 and is supported between the sidewalls 12, 13, the presser wheel 17 being located between the leading end 14 and the trailing end 15. The presser wheel 17 has on its circumference three rows of pointed projections or needles 18 (FIGS. 3 and 4), extending radially outwardly therefrom and spaced circumferentially apart from each other. The needles 18, as they arrive at a position adjacent to the open side 16 of the frame 11 during the rotation of the presser wheel 17 successively at least partially pierce an elongate gasket 19 and hold it against an edge 20 of a panel 21 such as a pane of glass. The gasket 19 has a cross-section which is generally that of an inverted U-shape. The presser wheel 17 has a periphery from which the needles 18 project. The portion of the periphery having those needles 18 that are in engagement with the gasket 19 is out of contact with the gasket 19. A pair of wheel flanges 22, 23 (FIGS. 3 and 4), disposed peripherally on the presser wheel 17, are spaced from each other axially of the presser wheel 17 with the rows of needles 18 disposed therebetween.

Figure 4:
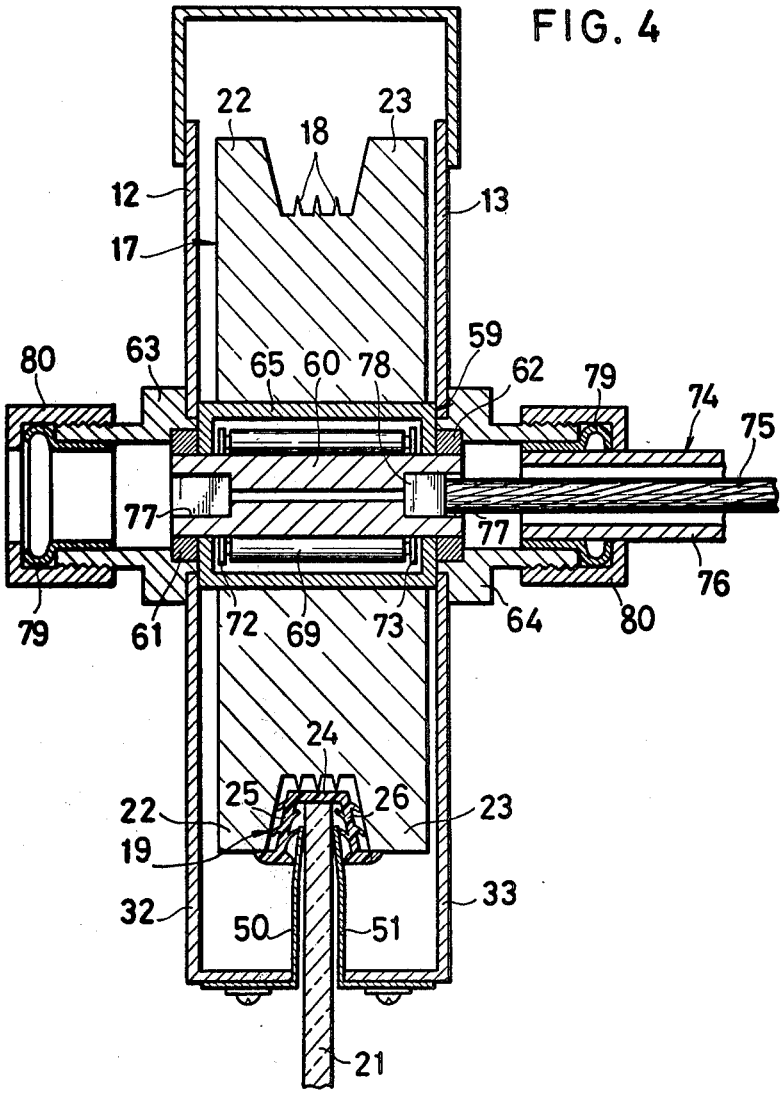
FIG. 4 is a cross-sectional view taken along line IV—IV of FIG. 1.

As best shown in FIG. 4, the elongate gasket 19 includes a bottom or bight 24 to be placed on the panel edge 20, the bight 24 interconnecting a pair of sidewalls 25, 26 to be held against the opposite surfaces of the panel 21 along the edge 20. During installation, the needles 18 on the wheel 17 engage the bottom 24 of the gasket 19 and press its inner surface against the panel edge 20, while the wheel flanges 22, 23 constrain the sidewalls 25, 26 of the gasket 19.

A gasket guide 27 (FIG. 2) is disposed in the hollow frame 11 adjacent to the leading end 14, the gasket guide 27 having a passage 28 for permitting the gasket 19 to pass therethrough. The passage 28 has an inlet opening (not shown) at one end and a discharge opening 29 at the other end, and extends at an angle to the open side 16 with the discharge opening 29 being adjacent to the open side 16. The discharge end 29 is spaced upwardly from the open side 16 and forwardly from the position where the needles 18 engage the gasket 19.

A cutter arm 30 (FIG. 1) is disposed in the hollow frame 11 and has a central limb 31 extending therefrom and pivoted at its distal end to a pair of legs 32, 33 projecting downwardly from the frame sidewalls 12, 13, respectively. The cutter arm 30 rotatably supports a guide roller 34 on one end, the guide roller 34 being disposed outside the frame 11 at its leading end. The guide roller 34 has a circumferential groove 35 (FIG. 3) and is adapted to ride over the edge 20 of the panel 21 in rolling engagement therewith for guiding the hollow frame 11 to move therealong. The cutter arm 30 has a cutter 36 fixed centrally thereto, the cutter 36 having a blade 37 directed toward the guide roller 34. The gasket guide 27 has a slot 38 extending across the passage 28.

The cutter arm 30 is pivotable to move the cutter blade 37 into and out of the slot 38.

A lever 39 is pivoted at one end to the frame 11 by a pin 40, the other end of the lever 39 being disposed over and movable toward and away from a handle 41 slidably supported on the frame 11 at its leading end. The handle 41 is mounted on a plate 42 projecting from the frame 11.

The cutter arm 30 has on the other end a small roller 44 engageable with the lever 39 so that the cutter arm 30 can be moved in response to the movement of the lever 39 toward the handle 41 to allow the cutter blade 37 to enter into the slot 38 across the passage 28. The lever 39 has a projection 45 directed toward and engageable with a portion 46 of the handle 41. When the lever 39 pivots toward the handle 41 until the projection 45 abuts against the handle portion 46, the lever 39 depresses the small roller 44 and hence the cutter arm 30 to permit the cutter blade 37 to be inserted halfway into the slot 38. The handle 41 has a recess 47 adjacent to the portion 46 for receiving therein the projection 45 on the lever 39. After the handle 41 has been slid toward the frame 11 to a position in which the recess 47 is in the path of movement of the projection 45, the lever 39 is pivotally moved toward the handle 41 until the projection 45 fully enters the recess 47. At this time, the cutter arm 30 is further depressed to enable the cutter blade 37 to be inserted substantially all the way into the slot 38. A spring 48 acts between the plate 42 and the handle 41 to normally urge the handle 41 in a direction away from the frame 11 to prevent the projection 45 on the lever 39 from being received in the recess 47 in the handle 41 when the lever 39 is moved closer to the handle 41.

A spring 49 (FIG. 1) acts between the frame 11 and the limb 31 on the cutter arm 30 to normally urge the cutter arm 30 upwardly, namely in a direction to retract the cutter blade 37 out of the slot 38.

As shown in FIG. 4, the downwardly extending legs 32, 33 have their distal ends bent toward one another. To the bent ends of the legs 32, 33 are respectively attached a pair of guide plates 50, 51 extending upwardly toward the presser wheel 17 substantially parallel to each other, the free edges thereof converging as they extend between the flanges 22, 23 on the wheel 17. As better illustrated in FIGS. 1 and 2, each guide plate extends from one of the legs 32, 33 toward the discharge opening 29 of the passage 28. In operation, the sidewalls 25,26 of the gasket 19 as it is pulled out of the discharge opening 29 are led by the guide plates 50, 51, respectively, with the panel 21 sandwiched therebetween, to slide thereover, backed by the wheel flanges 22, 23, to the position of engagement by the wheel needles 18.

A correction roller assembly 52 is mounted on the frame 11 at the trailing end 15 near the open side 16. The correction roller assembly 52 includes a central vertical roller 53 (FIGS. 2 and 3) rotatably supported between the frame sidewalls 12, 13 for pressing the gasket bottom 24 against the panel edge 20, and a pair of side horizontal rollers 54, 55 (FIGS. 1 through 3) rotatably mounted respectively on a pair of brackets 56, 57 fixed to the sidewalls 12, 13 for pressing the gasket sidewalls 25, 26 against the opposite surfaces of the panel 21 along its edge 20. Thus the correction roller assembly 52 corrects the gasket 19 installed by the presser wheel 17 into a proper disposition over the panel edge 20.

The correction roller assembly 52 serves as a guide to direct the device 10 for movement along the edge 20 of the panel 21 at a fixed distance therefrom.

Figure 5:
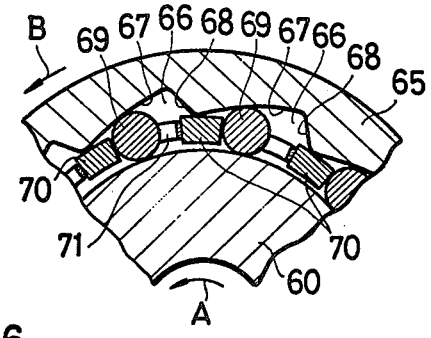
FIG. 5, on sheet 2, is an enlarged fragmentary cross-sectional view of a clutch mechanism in the device.

The presser wheel 17 is driven by an electric motor 58 (FIG. 6) through an overrunning or freewheeling clutch mechanism 59 contained in the presser wheel 17 (FIG. 4). The clutch mechanism 59 comprises a central shaft 60 coaxial with the wheel 17, the shaft 60 having a pair of end journals 61, 62 rotatably supported respectively by a pair of bearing fittings 63, 64 fixed to the sidewalls 12, 13, respectively, of the frame 11. Rotatably around the central shaft 60 and between the sidewalls 12, 13, there is mounted a sleeve 65 coaxial with and fixed to the wheel 17 for corotation therewith. As shown in FIG. 5, the sleeve 65 is internally toothed to provide a series of pockets 66 each bounded by a first surface 67 and a second surface 68, the first surface 67 being inclined more gradually than the second surface 68 with respect to the periphery of the central shaft 60. A series of rollers 69 are rotatably trapped in the pockets 66, respectively, for drivingly acting between the shaft 60 and the sleeve 65. Between the shaft 60 and the sleeve 65, there is disposed a retainer cage having a series of retainers or retainer bars 70 which are uniformly spaced peripherally around the shaft 60 and correspond in number to the rollers 69, one of the retainer bars 70 being positioned respectively between every adjacent pair of the rollers 69. Each roller 69 is urged away from one of the adjacent retainer bars 70 toward the other adjacent retainer bar 70 by a leaf spring 71 disposed between the roller 69 and said one of the bars 70. The retainer bars 70 are connected endwise to a pair of coupling disks 72, 73 (FIG. 4) rotatably disposed around the central shaft 60.

The overrunning clutch mechanism 59 can transmit motion when the central shaft 60 is driven to rotate in one direction only. More specifically, when the shaft 60 is rotated counterclockwise in the direction of the arrow A as shown in FIG. 5, each roller 69 becomes wedged between the first surface 67 of one of the pockets 66 and the periphery of the shaft 60, thereby causing the sleeve 65 to rotate with the shaft 60. At this time, each roller 69 can act on the first surface 67 simultaneously since each roller 69 is spring-biased against one of the retainer bars 70. Conversely, when the shaft 60 rotates in the clockwise direction which is opposite to that shown by the arrow A, the shaft 60 causes the rollers 69 to be held against the second surfaces 68 of the pockets 66. With the second pocket surfaces 68 being relatively steep with respect to the shaft periphery, no roller is wedged between the second surfaces 68 and the periphery of the shaft 60. Accordingly, the sleeve 65 is not driven by the shaft 60 while it is being rotated clockwise as shown in FIG. 5, or in other words the sleeve 65 is freely rotatable of its own accord in the counterclockwise direction of the arrow B while the shaft 60 is held at rest.

The shaft 60 is coupled to the electric motor 58 through a flexible cable 74 such as a Bowden cable having a cable core 75 enclosed by a protective sheath 76. The shaft 60 has a pair of end bores 77, 77 of noncircular cross section such as square cross section, a selected one of which receives therein an insert 78 of complementary cross section fixed to one end of the cable core 75, with one end of the sheath 76 inserted in one of the fittings 63, 64. Each of the bearing fittings 63, 64 has an inner sleeve 79 which, when forced by a cap 80 threaded over the fitting 64, grips the sheath 76 so as to prevent its removal from the fitting 64. The alternative bores 77 facilitate easy use of the device by both right-handed and left-handed users, and also enable the gasket to be installed with the device moving either clockwise or counterclockwise as viewed from a point at one side of the panel.

Figure 6:
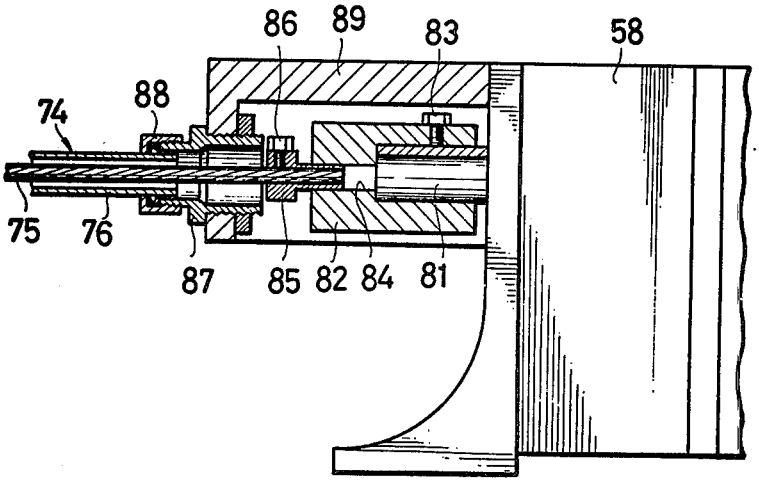
FIG. 6, on sheet 2, is a vertical cross-sectional view of a coupling between an electric motor and a drive cable.

As illustrated in FIG. 6, the motor 58 has a drive shaft 81 to which a coupling block 82 is fixed by means of a setscrew 83, the block 82 having a noncircular bore 84 such as of square cross section that is coaxial with the drive shaft 81, and receives therein an insert 85 of complementary cross section fixed to the other end of the cable core 75 by means of a setscrew 86 for driving connection between the shaft 81 and the cable core 75. The other end of the sheath 76 is retained in a fitting 87 by a cap 88 and a further inner sleeve as described above, the fitting 87 being fixed to a bracket 89 mounted on the motor 58.

The electric motor 58 contains an electromagnetic clutch (not shown) which is energizable on de-energization of the motor 58 to couple the drive shaft 81 with a brake (not shown). Thus the drive shaft 81 is stopped against rotation due to inertia as soon as the motor 58 is de-energized.

To install the gasket 11 on and over the panel edge 20, an end of the gasket 19 is inserted through the passage 28 until it extends under the presser wheel 17. Then, the lever 39 and the handle 41 are gripped together, and the electric motor 58 is actuated preferably through a foot switch to rotate the central shaft 60 counterclockwise (FIG. 5) and hence the presser wheel 17, thereby driving the gasket installing device 10 along the panel edge 20. The gasket 19 is pressed down by the presser wheel 17 so as to cover the panel edge 20 and, then, is rectified by the correction roller assembly 52 so as to be properly disposed over the panel edge 20. When the device 10 arrives near a corner of the panel edge 20, the motor 58 is deenergized whereupon the shaft 60 is stopped. Then, the gasket installing device 10 is pulled manually toward the corner of the panel edge 20, during which time the presser wheel 17 revolves around the nonrotating shaft 60 by its engagement with the gasket 19 that is being installed. When the device 10 reaches the corner of the panel edge 20. the guide roller 34 goes beyond and around the corner due to the force with which the lever 39 is pushed toward the handle 41. The cutter arm 30 is depressed and the cutter blade 37 partially enters the slot 38, whereupon it partially cuts the gasket 19 in the passage 28. The cutting movement of the cutter blade 37 is arrested at a point substantially halfway in the slot 38 by the engagement of the projection 45 on the lever 39 with the portion 46 of the handle 41. The location of the cutter 37 and the slot 38, and the positional relationship of the guide roller 34 therewith are such that the cut portions of the gasket 19 correspond to the corners of the panel edge 20 when the gasket 19 is completely installed around the panel 21, as shown in my copending application identified above.

When it is necessary to cut off the gasket 19, the handle 41 is pushed over toward the frame 11 to bring the recess 47 into the path of movement of the projection 45 on the lever 39 as the device 10 approaches a panel edge corner. Upon rolling movement of the guide roller 34 around the corner, the cutter arm 30 is allowed to pivot until the projection 45 on the lever 39 is seated in the recess 47 in the handle 41, whereupon the cutter blade 37 is caused to project substantially all the way into the slot 38 across and beyond the gasket 19 in the passage 28, thereby severing the gasket 19. The gasket installing device 10 can be removed simply by pulling it along and off the panel edge 20.

Although various minor modifications may be suggested by those versed in the art, it should be understood that I wish to embody within the scope of the patent warranted hereon, all such embodiments as reasonably and properly come within the scope of my contribution to the art.

I claim:

1. A device for installing an elongate gasket continuously along and surrounding an edge of a panel, comprising:

(a) a hollow frame;

(b) a circumferentially grooved guide roller rotatably mounted on said frame for rolling engagement in its groove with the panel edge for guiding said frame to move therealong;

(c) a circumferentially grooved presser wheel rotatably disposed in said hollow frame, said wheel having means in its groove for engaging and pressing the elongate gasket against the panel edge whereby the gasket becomes fully installed on the panel edge;

(d) a gasket guide disposed in said hollow frame and having a passage extending at an angle to an edge of said frame, said passage having a discharge opening adjacent to said presser wheel and to said frame edge;

(e) motor means for rotating said presser wheel in one direction; and (f) flexible cable means interconnecting said motor means and said presser wheel for transmitting torque from said motor means to said presser wheel.

2. A device according to claim 1, including one-way clutch means in said presser wheel operative between said cable means and said presser wheel for allowing the presser wheel to be rotated by said motor means in said one direction and for allowing the presser wheel to rotate in said one direction when said motor means is de-energized.

3. A device according to claim 2, said clutch means comprising a shaft journaled in said frame and coupled to said flexible cable means, a sleeve rotatably disposed around said shaft and fixed coaxially to said presser wheel, said sleeve having surface means, and a plurality of rollers rotatably disposed between said shaft and said sleeve, said rollers being wedgeable between said surface means and the periphery of said shaft when said motor means is actuated.

4. A device according to claim 3, said shaft having a pair of end bores of noncircular cross section, said flexible cable means including a cable core and a protective sheath enclosing said cable core, and said cable core having on one end thereof an insert of complementary cross section received in one of said end bores.

5. A device according to claim 3, including a pair of bearing means mounted on said frame, and a pair of journals fixed to said shaft and rotatably supported by said bearing means, respectively.

6. A device according to claim 1, said means on said presser wheel comprising a plurality of axially spaced rows of pointed projections.

* * * * *